US008936540B2

(12) United States Patent
Kueckelhan

(10) Patent No.: US 8,936,540 B2
(45) Date of Patent: Jan. 20, 2015

(54) PORTABLE EXERCISE DEVICE FOR THE POSTERIOR MUSCLE CHAIN

(76) Inventor: Martin Lanell Kueckelhan, Birmingham, AL (US)

( * ) Notice: Subject to any disclaimer, the term of this patent is extended or adjusted under 35 U.S.C. 154(b) by 686 days.

(21) Appl. No.: 13/025,873

(22) Filed: Feb. 11, 2011

(65) Prior Publication Data

US 2012/0208682 A1 Aug. 16, 2012

(51) Int. Cl.

| | |
|---|---|
| ***A63B 21/00*** | (2006.01) |
| ***A63B 71/00*** | (2006.01) |
| ***A63B 26/00*** | (2006.01) |
| ***A63B 23/02*** | (2006.01) |
| *A63B 71/02* | (2006.01) |

(52) U.S. Cl.

CPC ..... *A63B 23/0211* (2013.01); *A63B 21/1476* (2013.01); *A63B 2210/50* (2013.01); *A63B 2071/024* (2013.01); *A63B 2071/027* (2013.01)

USPC ..... 482/131; 482/140; 482/23

(58) Field of Classification Search

USPC ..... 482/23, 38, 39, 92, 131, 140

See application file for complete search history.

(56) References Cited

U.S. PATENT DOCUMENTS

| | | | | |
|---|---|---|---|---|
| 2,050,652 | A * | 8/1936 | Fleming | 482/140 |
| 3,246,893 | A | 4/1966 | Boggild et al. | |
| 3,513,491 | A * | 5/1970 | Gordon | 5/420 |
| 3,567,218 | A * | 3/1971 | Johnson | 482/140 |
| 3,754,757 | A * | 8/1973 | Bowen | 482/34 |
| 3,850,430 | A * | 11/1974 | Hamilton | 482/97 |
| 3,966,200 | A * | 6/1976 | Kirk | 482/23 |
| 4,046,373 | A | 9/1977 | Kim | |
| 4,116,434 | A * | 9/1978 | Bernstein | 482/140 |
| 4,185,816 | A * | 1/1980 | Bernstein | 482/140 |
| 4,223,492 | A * | 9/1980 | St. Clair | 52/157 |
| 4,376,532 | A * | 3/1983 | Hunstad | 482/71 |
| 4,457,510 | A * | 7/1984 | Pertschuk | 482/140 |
| 4,550,907 | A | 11/1985 | Melillo et al. | |
| 4,611,805 | A * | 9/1986 | Franklin et al. | 482/129 |
| 4,629,179 | A * | 12/1986 | Bizilia | 482/140 |
| 5,110,122 | A | 5/1992 | Moore et al. | |
| 5,205,804 | A | 4/1993 | Hall | |
| 5,417,636 | A | 5/1995 | Havens | |
| 5,467,978 | A * | 11/1995 | Paluch | 473/429 |
| 5,527,242 | A | 6/1996 | Gangloff | |
| 5,662,304 | A | 9/1997 | McDaniel | |
| 6,113,523 | A * | 9/2000 | Medina | 482/140 |
| 6,626,807 | B1 | 9/2003 | Richmond | |
| 6,629,389 | B1 * | 10/2003 | Rust | 52/157 |
| 6,890,289 | B2 | 5/2005 | Spinosa | |
| 7,115,051 | B2 * | 10/2006 | Hansberry | 473/423 |
| 7,946,588 | B1 * | 5/2011 | Hockman et al. | 273/406 |
| 8,002,648 | B1 * | 8/2011 | Quinn et al. | 473/417 |
| 2004/0209745 | A1 | 10/2004 | Riney et al. | |
| 2005/0211282 | A1 * | 9/2005 | DeVenezia et al. | 135/16 |
| 2007/0079535 | A1 * | 4/2007 | Newton | 40/124 |
| 2007/0200046 | A1 * | 8/2007 | Tota | 248/545 |
| 2007/0231083 | A1 * | 10/2007 | Nolan | 405/259.1 |

(Continued)

*Primary Examiner* — Stephen Crow
*Assistant Examiner* — Garrett Atkinson
(74) *Attorney, Agent, or Firm* — Maier & Maier, PLLC

(57) ABSTRACT

A portable exercise device for the posterior muscle chain. The portable exercise device can include a first anchor and a second anchor, the anchors being oriented substantially vertically, and at least one central member coupled to and extending between the first anchor and the second anchor. The anchors can include a housing, a handle portion rotatably disposed at a first end of the housing, and an anchoring portion operatively coupled to the handle portion and disposed at a second end of the housing.

5 Claims, 2 Drawing Sheets

(56) References Cited

U.S. PATENT DOCUMENTS

2008/0070754 A1* 3/2008 Gonzalez Monroy ..... 482/38
2009/0151296 A1* 6/2009 Perry ..... 52/741.4
2009/0309007 A1* 12/2009 Hazelwood ..... 249/213
2011/0036024 A1* 2/2011 Reinhardt ..... 52/157

* cited by examiner

PORTABLE EXERCISE DEVICE FOR THE POSTERIOR MUSCLE CHAIN

BACKGROUND

Exercise techniques and apparatuses for strengthening and toning a user's muscle groups are known in the art. Typically, such techniques and apparatuses are intended to facilitate the exercise of a particular group, or several groups of muscles in a region of the body. For example, to exercise the posterior chain of muscles—that is, the lower back, gluteal muscles, and hamstring muscles—there is an effective exercise known as the glute-ham raise. The glute-ham raise exercise typically involves the user kneeling down, securing his feet such that the legs are parallel or almost parallel to the floor, and, with the knees as a fulcrum, utilizing the posterior chain of muscles to so as to lower the torso towards the floor, and to subsequently raise the torso into the original position.

The drawback of the glute-ham raise exercise is that the lower legs need to be secured in one position. This may be accomplished either by another person, or by a significant amount of weight applied to the user's lower legs. Consequently, known exercise apparatuses configured for the glute-ham raise exercise, or for analogous exercises, are typically heavy, including weights or weighed bases that act as a counterweight for the weight of the user while securing the user's ankles. As such apparatuses are heavy, they are not configured for portability. Thus, an individual wishing to exercise the posterior chain of muscles would need to obtain cumbersome and unwieldy exercise equipment, visit a gym or exercise room, or request assistance from another individual, who can secure the lower legs so that the exercises can be performed. This presents a problem for individuals who are frequently on the go, or who do not have convenient access to a gym or exercise room. Therefore, a lightweight and portable device for facilitating exercise of the posterior chain of muscles is needed.

SUMMARY

According to at least one exemplary embodiment, a portable exercise device for the posterior muscle chain is disclosed. The portable exercise device can be lightweight, capable of fitting in small spaces such as luggage or the trunk of a car, and may not require any assembly by the user. The portable exercise device can allow the user to perform the glute-ham exercise without any assistance and without using any counterweights. The portable exercise device can be adapted to be anchored in a granular medium, such as, for example, soil, sand, gravel, and the like. The portable exercise device can include a first anchor and a second anchor, the anchors being oriented substantially vertically, and at least one central member coupled to and extending between the first anchor and the second anchor. The anchors can include a housing, a handle portion rotatably disposed at a first end of the housing, and an anchoring portion operatively coupled to the handle portion and disposed at a second end of the housing. The anchoring portions can include an auger having a helical flight and a corkscrew disposed adjacent to the auger.

According to another exemplary embodiment, a portable exercise system for the posterior muscle chain is disclosed. The portable exercise system can include the above-described portable exercise device and a mat. The mat can be formed from a resilient material and can include a support pad. The support pad can include at least one knee supporting portion and a thigh supporting portion.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
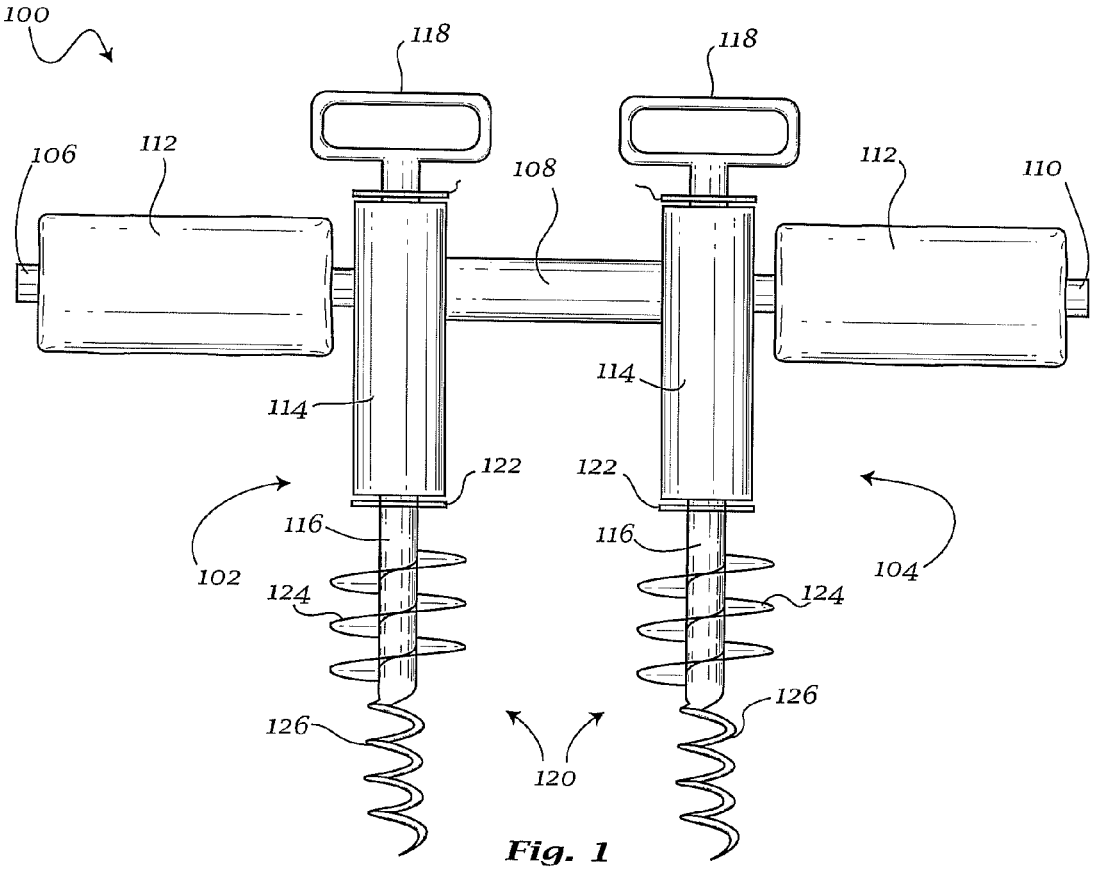
FIG. 1 shows an exemplary embodiment of a portable exercise device for the posterior muscle chain.

FIG. 1 shows an exemplary embodiment of an exercise device 100. Exercise device 100 may include a first anchor 102, a second anchor 104, a first end member 106, a central member 108 and a second end member 110. First and second anchors 102, 104, may be oriented substantially vertically, while central member 108 and first and second end members 106, 110 may be oriented substantially horizontally. Central member 108 may have a length of approximately 6 inches, while each of end members 106, 110 may have a length of approximately 9 inches. Central member 108 may be coupled to both anchors 102, 104 such that it is disposed between the two anchors. First end member 106 may be coupled to first anchor 102 such that the first end member is parallel to central member 108. Similarly, second end member 110 may be coupled to second anchor 104 such that the second end member is parallel to central member 108. Each of first and second end members 106, 110 may have padding 112 coupled thereto, for example a cylindrical cushion. Padding 112 may be any type of resilient member that can provide a padded surface so as to facilitate the user's comfort when the user's ankles are in contact with the end members. Central member 108 and first and second end members 106, 110 may be coupled to first and second anchors 102, 104, such that the central and end members are disposed substantially near the top of the anchors. Alternatively, central member 108 may be disposed at a lower point of the anchors 102, 104, or a plurality of central members may be utilized if desired.

Each of first and second anchors 102, 104 may include a housing 114, a rotatable handle portion 118 and an anchoring portion 120 operatively coupled to the handle portion. Anchoring portion 120 may have a length of approximately 13 inches. Handle portion 118 and anchoring portion 120 may be operatively coupled via a rod 116. Housing 114 may be hollow, or may have a longitudinal passage defined therethrough. The longitudinal passage may have a diameter of sufficient width to receive rod 116 therethrough and allow rod 116 to rotate freely therein. Additionally, a pair of plates 122 may be coupled to rod 116, the plates having a diameter substantially similar to the diameter of housing 114. The distance between the two plates 122 may be substantially similar to the height of housing 114. Alternatively, plates 122 may arranged such that they have a diameter slightly greater than the diameter of the longitudinal passage of housing 114 and may be received within horizontal grooves that are defined within the longitudinal passage, or the plates may have a diameter substantially similar to the diameter of the longitudinal passage and may be received between horizontal ridges that are defined within the longitudinal passage. Thus, the plates can minimize the vertical movement of rod 116 within housing 114 while allowing the rod to rotate freely within the cylindrical sleeve.

Handle portion 118 may be disposed substantially near the upper end of housing 114. Handle portion 118 may include at least one horizontal member that the user may grip to rotate rod 116. Handle portion 118 may also include ergonomic features, for example ridges, grooves, bumps, or the like, so as to facilitate ease of gripping and rotating the handle portion, and may further include resilient materials to facilitate comfortably gripping and rotating the handle portion. Handle potion 118 may extend beyond the diameter of housing 114 so as to allow the user to generate additional torque, thereby providing a mechanical advantage when rotating handle portion 116.

Anchoring portion 120 may be disposed substantially near the lower end of housing 114 and may include structures for facilitating the anchoring of exercise device 100 in the ground, for example, in soil, sand, gravel, silt or any other granular medium. In one exemplary embodiment, the anchoring structures may include an auger portion 124 and a corkscrew portion 126. Corkscrew portion 126 may be disposed at the lower end of the anchoring portion of rod 116, while auger portion 124 may be disposed above corkscrew portion 126 and below the lower of plates 122. Auger portion 124 may include a helical screw flight. Corkscrew portion 126 may facilitate the penetration of the granular medium by the anchoring portion of exercise device 100 while auger portion 124 may facilitate the stability of exercise device 100 in the ground. To that end, the diameter and pitch of the helical screw flight of auger portion 124 may be such that a counterforce sufficient to maintain exercise device 100 in the ground is exerted on the surrounding granular medium when the user exerts an upward force on bars 106, 110 of exercise device 100.

Figure 2:
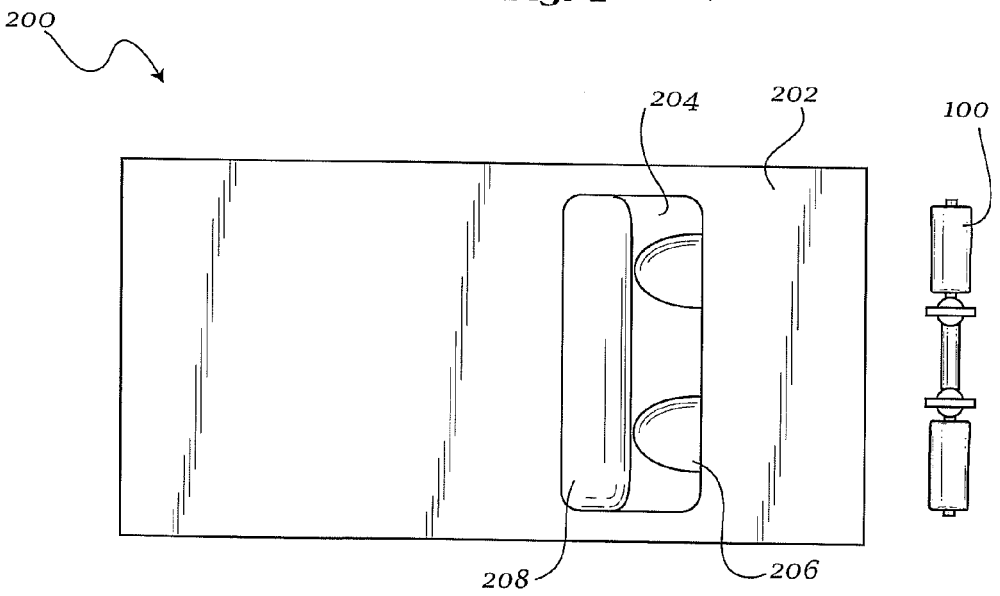
FIG. 2 shows an exemplary embodiment of a portable exercise system for the posterior muscle chain.

Turning to FIG. 2, a portable exercise system 200 may include portable exercise device 100 and mat 202. Mat 202 may be adapted to provide a comfortable surface for the user while performing the exercises. Mat 202 may be formed from a resilient material, for example closed-cell foam, PVC, rubber, or any other resilient material known in the art. Mat 202 may further include a support pad 204. Support pad 204 may be shaped so as to support and provide cushioning for the user's knees and thighs while the user is performing the exercise. To that end, knee pad 204 may include knee support areas 206 and a thigh support area 208. Support areas 206, 208 may be shaped or contoured as desired to facilitate providing comfortable support for the user's knees and thighs. Additionally, the compressibility of knee pad 204 may be greater than that of the rest of mat 202 so as to provide greater cushioning and so as not to impede the movement of the user's thighs while the exercise is being performed. Mat 202 may also be adapted to be folded, collapsed, or rolled into a compact configuration for ease of transport, and may also be adapted to be fastened to exercise device 100 so as to maintain the components of system 200 together during transport.

Figure 3:
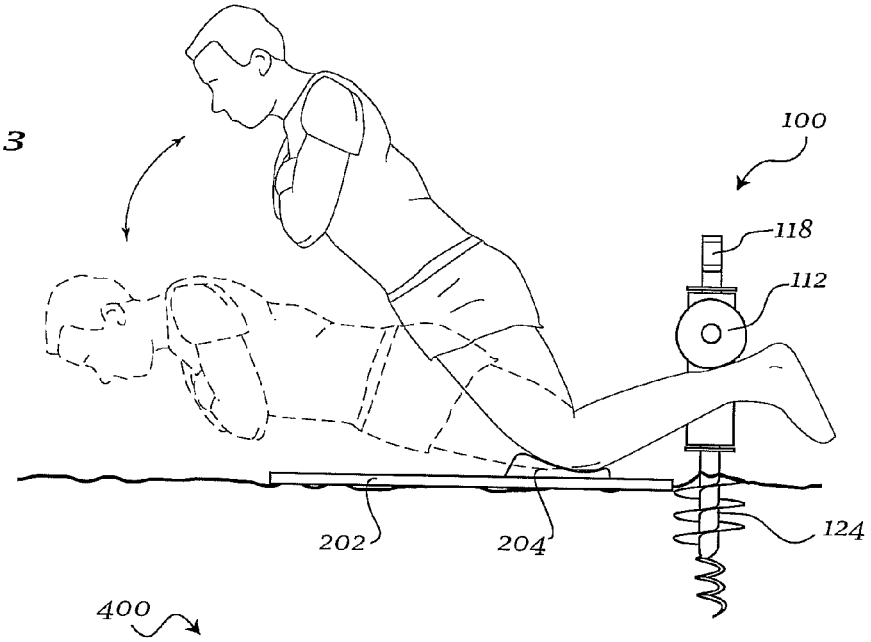
FIG. 3 shows an exemplary embodiment of a portable exercise system in use, illustrating exemplary exercise positions.

Turning to FIG. 3, to perform the exercise, the user can anchor exercise device 100 in the ground by positioning the exercise device at the desired location and turning handle portions 118 of first and second anchors 102, 104 such that anchoring portions 120 penetrate and descend into the ground on which the exercise device is located. Once the exercise device is sufficiently stable and positioned at the desired height, the user can place mat 202 proximate to the exercise device such that when the user's knees are positioned on the knee pad, the user's ankles are in contact with the padding 112 of first and second end members 106, 110. The user can then assume the kneeling position shown in FIG. 3, with the ankles in contact with padding 112 and the knees located on support pad 204. Subsequently, the user can lean forward slowly by gradually lowering the upper body until in the prone position, using the posterior muscle chain to accomplish the movement. The user can then use the arms to push the torso upwards, while again utilizing the posterior muscle chain to accomplish the return to the initial position. The exercise can then be repeated as desired. Once the user has completed the exercise routine, exercise device 100 can be unanchored from the ground by turning handle portions 118 in the opposite direction and withdrawing the exercise device from the ground.

Figure 4A:
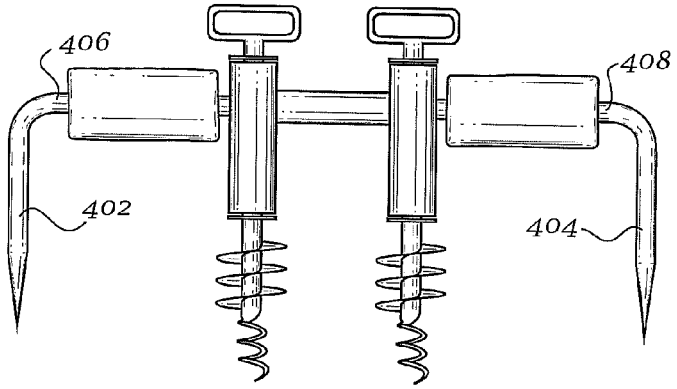
FIG. 4*a* shows another exemplary embodiment of a portable exercise device for the posterior muscle chain.

FIG. 4*a* shows another exemplary embodiment of exercise device 400. Exercise device 400 may include first and second supports 402, 404 coupled to first and second end members 406, 408. Supports 402, 404 may have a tapered lower end and may serve to provide additional stability while exercise device 400 is being anchored in the ground and while the exercise device is being used.

Figure 4B:
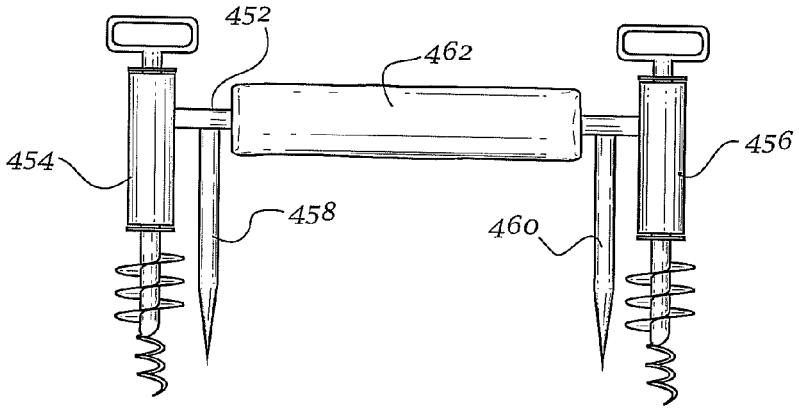
FIG. 4*b* shows another exemplary embodiment of a portable exercise device for the posterior muscle chain.

FIG. 4*b* shows another exemplary embodiment of exercise device 450. Exercise device may include a central member 452, first and second anchors 454, 456, and first and second supports 458, 460. Central member 452 can be disposed between anchors 454, 456 and can be coupled to both anchors substantially near the top of the anchors. Supports 458, 460 may be coupled to the central member and may be disposed between anchors 454, 456, or may be coupled to the anchors and disposed to the outside of the anchors. Supports 458, 460 may have a tapered lower end and may serve to provide additional stability while exercise device 450 is being anchored in the ground and while the exercise device is being used. Horizontal bar 452 may have padding 462 coupled thereto, for example a cylindrical cushion. The padding may be any type of resilient member that can provide a padded surface so as to facilitate the user's comfort when the user's ankles are in contact with the outer bars. The embodiment of exercise device 450 having a single central member for engaging the user's can thus allow the user to position the legs at a narrower span than the embodiments of the exercise having a pair of end members for engaging the user's legs.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A portable exercise device for a posterior muscle chain, comprising:

a first auger and corkscrew anchor and a second auger and corkscrew anchor, the first and second auger and corkscrew anchors being oriented substantially vertically, the first auger and corkscrew anchor and the second auger and corkscrew anchor each formed integrally with a t-handle at an opposite end from the first and second auger and corkscrew anchors and disposed inside a first housing and a second housing, respectively, wherein the first housing and the second housing facilitate free rotation of the t-handle integrally formed with the first auger and corkscrew anchor and the second auger and corkscrew anchor within the first housing and the second housing, respectively;

a central member coupled to and extending between the first housing and the second housing;

a first end member coupled to and extending outward from the first housing; and a second end member coupled to and extending outward from the second housing, wherein the first housing is between the first end member and the central member, and the second housing is between the second end member and the central member and wherein each of the first housing and the second housing extend above and below the central member; and further comprising at least one padding member coupled to each of the first end member the second end member; whereby a user can mount the device in a ground surface and anchor his or her body during exercise.

2. The portable exercise device of claim 1, wherein the first end member and the second end member are oriented substantially horizontally.

3. The portable exercise device of claim 1, further comprising at least one vertical support member coupled to the central member.

4. The portable exercise device of claim 1, further comprising at least one vertical support member coupled to each of the first end member and the second end member.

5. The portable exercise device of claim 1, further comprising at least one padding member coupled to the central member.

* * * * *